US007575134B2

(12) United States Patent
Martin et al.

(10) Patent No.: US 7,575,134 B2
(45) Date of Patent: Aug. 18, 2009

(54) SELF-SEALING NOZZLE FOR DISPENSING APPARATUS

(76) Inventors: James H. Martin, 8322 County Line Rd., Burr Ridge, IL (US) 60527; Yuri M. Gallegos, c/ Pep Ventura #59, 3, 1, Sant Pere de Ribes, Barcelona (ES) 08810; Jordi Romanyo i Alba, Sagrada Familia, 42, Sant Pere de Ribes (ES) 08810

( * ) Notice: Subject to any disclaimer, the term of this patent is extended or adjusted under 35 U.S.C. 154(b) by 487 days.

(21) Appl. No.: 11/369,400

(22) Filed: Mar. 7, 2006

(65) Prior Publication Data

US 2006/0208007 A1 Sep. 21, 2006

Related U.S. Application Data

(60) Provisional application No. 60/662,910, filed on Mar. 17, 2005.

(51) Int. Cl.
*B65D 5/72* (2006.01)

(52) U.S. Cl. ..... 222/494

(58) Field of Classification Search ..... 222/494, 222/491, 402.1, 402.12, 153, 153.13, 497, 222/96, 493, 492, 499, 321.3, 380; 239/333, 239/337; 137/853, 614.2

See application file for complete search history.

(56) References Cited

U.S. PATENT DOCUMENTS 3,584,789 A 6/1971 Traynor
3,940,070 A * 2/1976 Boris ..... 239/333
3,976,223 A 8/1976 Jass
4,013,231 A 3/1977 Van Veldhoven
4,274,560 A 6/1981 Cater
4,580,701 A 4/1986 Tamaki
4,690,312 A 9/1987 Crapser
4,830,284 A * 5/1989 Maerte ..... 239/333
5,027,982 A 7/1991 Demarest
5,180,109 A * 1/1993 Schwartzbauer et al. .... 239/346
5,236,106 A 8/1993 Laska
5,497,946 A 3/1996 Laidler
5,918,774 A 7/1999 Lund
6,062,432 A 5/2000 Estrada
6,257,503 B1 * 7/2001 Baudin ..... 239/337
6,382,463 B2 5/2002 Meshberg
6,543,703 B2 * 4/2003 Blake ..... 239/106
2005/0211798 A1 * 9/2005 Garcia et al. ..... 239/333

* cited by examiner

*Primary Examiner*—Kevin P Shaver
*Assistant Examiner*—Michael Hagedorn
(74) *Attorney, Agent, or Firm*—Robert L. Marsh

(57) ABSTRACT

A self-sealing nozzle for a liquid dispensing device having a valve and a discharge port, the discharge port including a plug that may be bulbous in shape, the plug being retained by a retainer at the end of the discharge passage leading to the port. An elastomeric seal has an annular inner surface that seals against the plug when liquid is not being dispensed by said valve, but expands and forms a passage around the plug when liquid is being dispensed by said valve.

9 Claims, 11 Drawing Sheets

SELF-SEALING NOZZLE FOR DISPENSING APPARATUS

The applicants claims priority from their previously filed provisional application filed Mar. 17, 2005 and assigned Ser. No. 60/662,910. The present application relates to dispensing valves and in particular to a nozzle for such a valve that will self-seal after each use so that contaminants in the ambient will not enter the passage between the mechanics of the valve and the nozzle.

BACKGROUND OF THE INVENTION

The typical dispensing device has a container filled with a liquid, gas or gel and at one end of the container is a dispensing valve, which when actuated, dispenses a desired amount of fluid within the container. Such dispensing devices are used to dispense desired amounts of chemical, such as hair spray, deodorant, bug spray, soaps, glue and various forms of medication. In a typical dispensing device, the valve is actuated by depressing or tilting an actuator attached to the stem extending from one end of the valve. The valves available for such dispensing devices have any number of structures. Some valves operate as a pump such that less liquid is pumped out when the stem is partially depressed than when fully depressed. Other valves merely release pressurized liquid in the container, and for such valves the amount of liquid dispensed is determined by the length of time that the stem is retained in the depressed or tilted position. In my U.S. Pat. No. 5,085,351, 1 disclosed a valve which dispenses a fixed amount of liquid each time the valve is actuated.

When the valve of the dispensing device is actuated, a portion of the contents in the container is forced through the stem of the valve and out a nozzle located in the actuator attached to the portion of the stem extending outward of the container. After the valve ceases to dispense the fluid, the dispensing passage extending from the mechanics of the valve through the stem, and through a portion of the actuator to the nozzle remains open to the ambient. Where the device is used to dispense a substance that degrades or undergoes a change in properties as a result of exposure to the ambient, it is desired that any remaining liquid left in the passage through the stem and the dispensing actuator and nozzle be sealed against the ambient after each actuation of the valve. It is particularly desirable to seal this passage when the valve is used to dispense medication and the like to thereby prevent harmful contaminants from entering the passage.

It would be desirable, therefore, to provide a nozzle for a dispensing valve that is fitted at the distal end of the passage that will seal the passage after each actuation of the valve without interfering with the dispensing process.

SUMMARY OF THE INVENTION

Briefly, the present invention is embodied in a self-sealing nozzle for a liquid dispensing device having a discharge passage leading to a discharge port. One embodiment of the device includes a plug that may be bulbous or cylindrical in shape having a stem that extends into the discharge passage leading to the port. The cross-sectional shape of the discharge passage is different than the cross-sectional shape of the stem extending from the plug such that a smaller passage remains between the wall of the discharge passage and the outer surface of the stem, the smaller passage extending along the length of the stem and around a portion of the plug.

In a second embodiment the plug is retained at the open end of the discharge passage by a plurality of ribs. Fluid released by the valve into the discharge passage will pass through the openings between the ribs to the outer surface of the plug and around the plug.

The device further includes an expandable collar fitted around the plug which is retained at the distal end of the discharge port. The expandable collar has an annular inner surface that seals against the plug when liquid is not being dispensed through the port. When liquid is being dispensed through the port, the inner surface of the collar is expanded by the pressure of the liquid being expelled so as to be spaced from the surface of the plug. The liquid expelled by the dispensing valve is thereby allowed to pass around the outer surface of the plug and within the inner surface of the expanded collar.

After liquid is dispensed through the nozzle, the collar retracts to its unstressed condition where it again seals against the surface of the bulb thereby sealing the passage that extends between the bulb and the mechanics of the valve and operates independent of the movement of the actuator.

BRIEF DESCRIPTION OF THE DRAWINGS

A better understanding of the invention will be had after a reading of the following detailed description taken in conjunction with the drawings wherein.

DETAILED DESCRIPTION OF A PREFERRED EMBODIMENT

Figure 1:
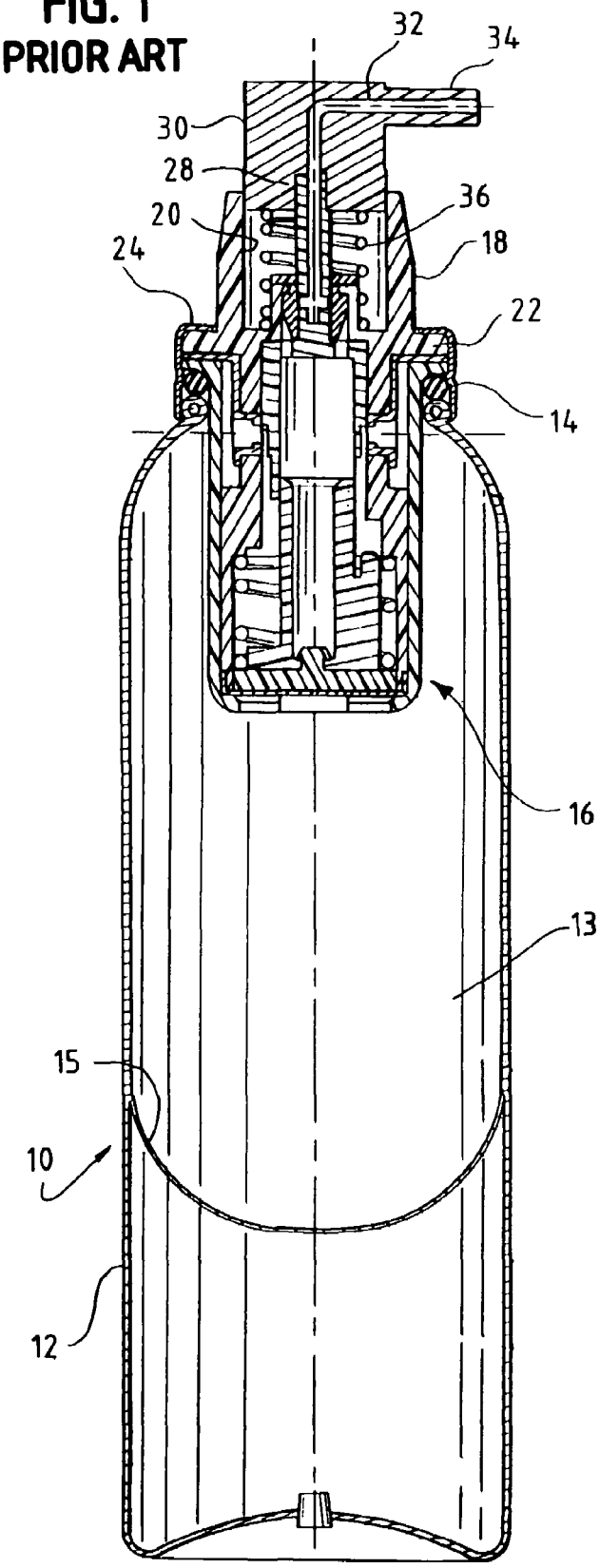
FIG. 1 PRIOR ART
FIG. 1 is a cross-sectional view of a liquid dispensing device including a valve and an actuator having a dispensing nozzle.

Referring to FIG. 1, a dispensing device 10 includes a container 12, and within the container 12 is a quantity of liquid, gas, or gel 13 to be dispensed by the device 10 commonly know as a barrier bag 15. For the purposes of this discussion, the device 10, and the various components depicted in all the drawings will be described with respect to their vertical orientation as depicted in FIG. 1. Accordingly, the container 12 has a mouth 14 at the upper end thereof and fitted into the mouth 14 of the container is a dispensing valve 16. The valve 16 has a tubular upper end 18 with a cylindrical inner surface 20 and a radial flange 22 having a diameter at least equal to the diameter of the mouth 14 of the container 12. Fitted around the outer surface of the mouth 14 of the container 12 and the flange 22 of the valve 16 is an annular seal 24 that seals and retains the annular flange 22 of the valve 16 against the mouth 14. With the parts assembled, the liquid 13 in the container 12 can only escape therefrom by passing through the chambers and passageways of the valve 16.

Extending coaxially through the tubular upper end 18 of the valve 16 is a depressible tubular stem 28 through which the liquid 13 in the container 12 is released when the mechanics of the valve 16 are actuated. At the distal end of the stem 28 is an actuator 30, and extending through the actuator 30 is a passageway 32 having one end in communication with the distal end of the tubular stem 28 and the other end 34 of the passage 32 in communication with the ambient. A spring 36 fitted around the tubular stem 28 and within the cylindrical surface 20 of the upper end 18 of the valve 16 urges the actuator 30 outward of the container 12 and valve 16.

There are many structures for a valve 16 useable to dispense the liquid 13 from the device 10, and the present invention is not dependent upon the structure of the valve 16. For the purpose of this discussion, however, the liquid 13 will be described as being a medication and the valve 16 will be described as operating in the manner of the valve described in my U.S. Pat. No. 5,085,351 and in other patents describing improvements thereto. The valve 16 is therefore actuated by depressing the tubular stem 28 into the body of the valve 16 and against the pressure of the spring 36 until the passages of the valve 16 open and allow a fixed amount of liquid medication to be discharged through the tubular stem 18, and through the passage 32 and out the nozzle 34. When the valve 16 is not in a dispensing cycle, however, the inner walls of the passage 32 and the inner walls of the tubular stem 28 are either filled with undispensed medication 13 or are in communication with the ambient. If the medication 13 in the container 12 is to be ingested into the body of a patient or applied to a patient's skin, it is desirable that the outer end 34 of the passage 32 be sealed against the ambient.

Referring to FIGS. 1 and 2 through 4, a self-sealing actuator 40 can be substituted for the actuator 30 and used with the dispensing valve 16 of the device 10. The self-sealing actuator 40 has a generally cylindrical outer wall 42 sized to be slideably received within the cylindrical inner surface 20 of the tubular end 18 of the valve 16 and has an upper surface 44 against which the thumb or forefinger of a user may be used to actuate the valve. Extending radially outward of the upper end of the self-sealing actuator 40 is a discharge tube 46. Extending vertically from lower end 47 of the self-sealing actuator 40 and into the body thereof is a large diameter cavity 48 sized to receive the upper end of the spring 36 for urging the self-sealing actuator 40 upwardly. Extending downwardly from the upper end of the cavity 48 is a small diameter tubular portion 49 having generally cylindrical upwardly opening cavity 50 sized to tightly receive the distal end of the stem 28. At the distal end of the discharge tube 46 is a self-sealing nozzle 54 in accordance with the present invention. When the self-sealing actuator 40 is depressed against the spring 36, the stem 28 is urged downward into the valve 16 thereby actuating the valve, after which a desired quantity of the liquid medication 13 in the container 12 is forced through the stem 28, through the passage 52 and out the nozzle 54.

In the following discussion, where the parts of the nozzle 54 have portions that are directed radially toward the stems 28, those parts will be described as being "inward," "rearward," or "behind" portions that are directed radially away from the stem 28, and the portions directed away from the stem 28 will be described as being "outward" or "forward." Accordingly, referring to FIG. 4, the discharge tube 46 has a cylindrical large diameter portion 56 and outward, or forward, of the large diameter 56 is a cylindrical small diameter nipple 58, with a generally planar annular transverse shoulder 60 extending between the large diameter portion 56 and the nipple 58. Between the large diameter portion 56 and the body of the self-sealing actuator 40 is an annular groove 62, the inner diameter of which is a little smaller than the large diameter portion 56.

The passage 52 extends through the cylindrical large diameter portion 56 and the nipple 58 and has a generally frustoconical countersink 64 at the distal end thereof. A short portion 68 of the passage 52 adjacent the countersink 64 has an enlarged diameter and one end of the enlarged diameter portion 68 defines a shoulder 66 with the remainder of the passage 52.

Figure 3:
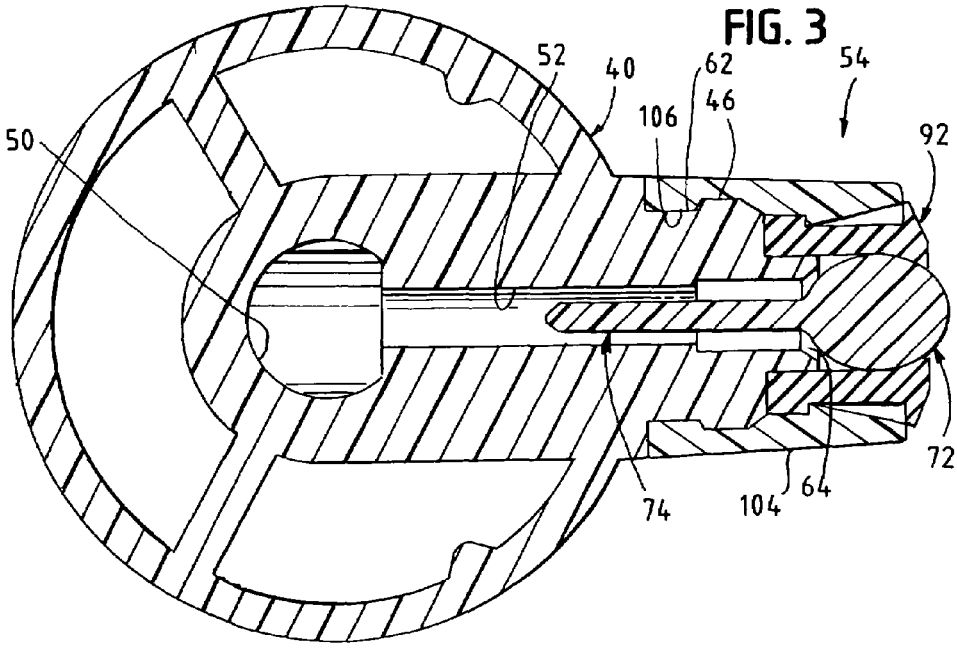
FIG. 3 is a cross-sectional view of the nozzle shown in FIG. 2 taken through line 3-3 thereof.
Figure 4:
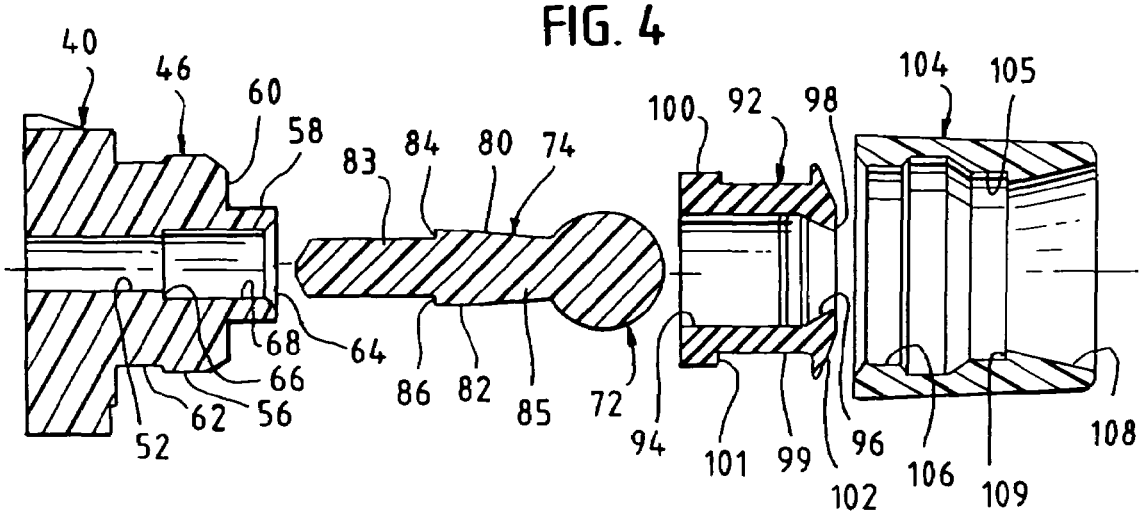
FIG. 4 is an exploded cross-sectional view of the nozzle shown in FIG. 2.
Figure 5:
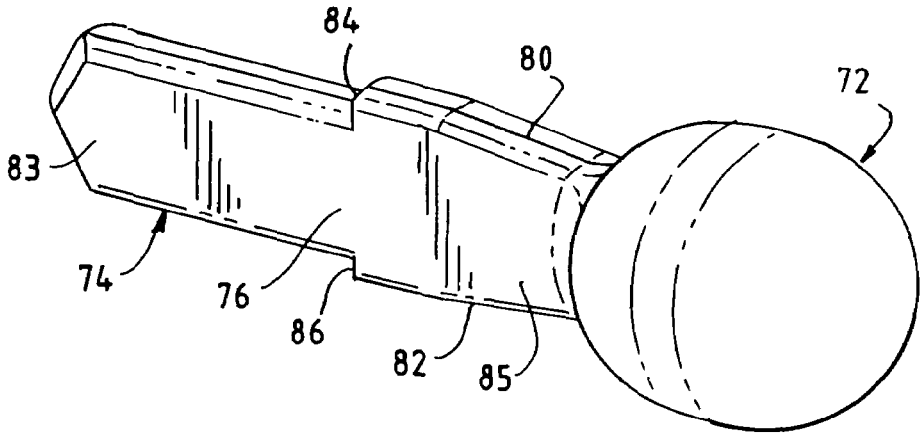
FIG. 5 is a further enlarged isometric view of the embodiment of a plug and stem from the nozzle shown in FIG. 2.
Figure 6:
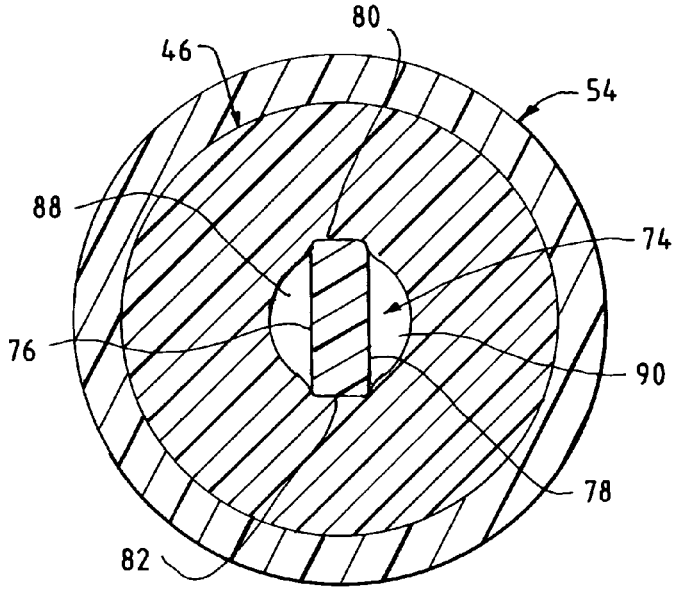
FIG. 6 is an enlarged cross-sectional view of the stem attached to the plug and a portion of the actuator as shown in FIG. 2 taken through line 6-6 thereof.

Referring to FIGS. 2 through 6, the nozzle 54 further includes a plug 72 that may be generally spherical, or cylindrical, or any of a number of configurations. In the depicted embodiment, the plug 72 is generally spherical and made of a hard material such as a hard plastic. The plug 72 has extending from a surface thereof an elongate stem 74. As best shown in FIGS. 5 and 6, the stem 74 has generally planar opposing surfaces 76, 78 and joining the ends of the planar surfaces 76, 78 are arcuate segments 80, 82. Midway along the length of the stem 74 are a pair of opposing shoulders 84, 86 such that the width of the planar surfaces 76, 78 is divided into a narrower outer portion 83 and a broader inner portion 85. The arcuate segments 80, 82 of the broader inner portion 85 are spaced from each other a distance that permits the broader inner portion 85 to be tightly received into the enlarged diameter portion 68 of the passage 52 and the arcuate segments 80, 82 of the narrower outer portion 83 are spaced apart a distance that permits the narrower outer portion 83 to be tightly received in the diameter of the remaining portion of the passage 52. The tight fit between the radially outward ends of the segments 80, 82 against the inner surface of portion 68 of the passage and between the narrow end 83 and portion 52 of the passage retains the stem 74 and bulb 72 within the nozzle 52.

Figure 2:
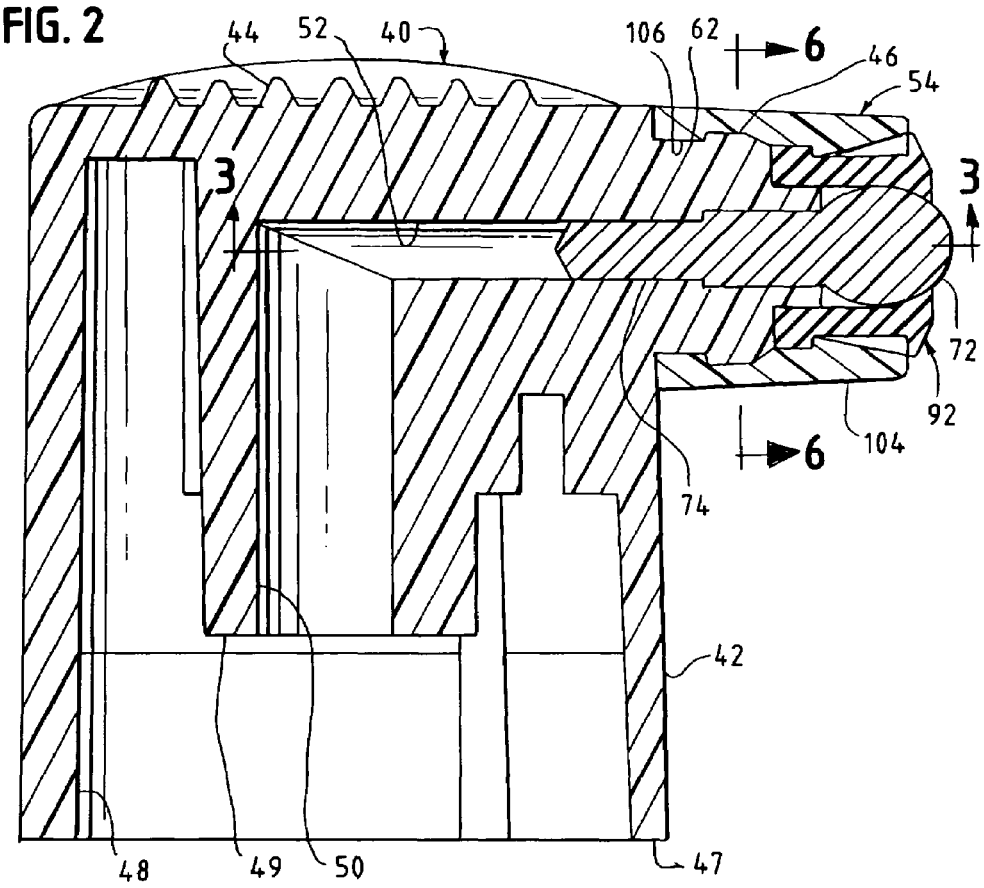
FIG. 2 is an enlarged cross-sectional view of an actuator fitted with a nozzle in accordance with the present invention.

To allow fluid to flow around the plug 72, the length of the inner portion 85, that is, the distance from the surface of the plug 72 to the shoulders 84, 86, is a little greater than the distance from the outermost end of the counter sink 64 to the shoulder 66. As best shown in FIGS. 2 and 3, the stem 74 is inserted into the passage 52, it will be slideably received therein until the shoulders 84, 86 of the stem 74 abut against the shoulder 66 in the passage 52. With the stem 74 fully inserted into the passage 52 and the shoulders 84, 86 abutting the shoulder 66, the plug 72 will be spaced a short distance from the countersink 64. As best shown in FIGS. 2, 3, and 6, with the stem 74 in the passage 52, there remains a pair of reduced sized smaller passageways 88, 90 along the planar surfaces 76,78 on opposite sides of the stem 74 that extend to the outer surface of the plug 72.

Referring further to FIGS. 2, 3 and 4, the device includes an elastomeric tubular seal 92 having a generally cylindrical inner surface 94 and at the forward end thereof is a frustoconical portion 96 ending in a smaller diameter opening 98. The central portion of the outer surface 99 of the tubular seal 92 is generally cylindrical and has a cylindrical outwardly directed flange 100 at the rear end thereof and between the central portion 99 and the radial flange 100 is an annular shoulder 101. At the opposite end of the seal 92, the outer surface has a radial flange 102 having a frustoconical end surface. The cylindrical inner surface 94 of the seal 92 is sized to receive the plug 72 and the frustoconical portion 96 is shaped to seal against the outermost end of the plug 72 when the elastomeric material of the seal 92 is in its unstressed condition. When the tubular seal 92 is fitted around the plug 72 at the distal end of the discharge tube 46, the cylindrical inner surface 94 will also receive the nipple 58 at the end of the discharge tube 46.

The tubular seal 92 may be bonded to the end of the nipple 58 by a suitable adhesive, not shown, or may be overmolded directly onto the surface of the nipple 58. Referring to FIGS. 2 through 4, as yet another alternative, the seal 92 may be held in place at the end of the nipple 58 and around the bulb 72 by a retaining sleeve 104, the inner surface 105 of which is generally complementary to the outer surface of the cylindrical large diameter portion 56 of the discharge tube 46 and the outer surface of the tubular seal 92. In another variation, the tubular seal 92 may be over molded into the retaining sleeve 104 so that these two elements form a single part. At the rearward end of the retaining sleeve 104 is a smaller diameter inwardly directed flange 106 sized to be received in the annular groove 62 surrounding the discharge tube 46 to thereby hold the retaining sleeve 104 to the end of the discharge tube 46. The forward end of the inner surface 105 of the retaining sleeve 104 has a frustoconical or flared portion 108 having an end diameter that is larger than the outer diameter of the outer end of the seal 92 such that the outer end of the seal 92 is expandable within the frustoconical portion 108 in response to pressure applied by liquid being released by the valve 16 and expelled out the discharge passage 52. The inner surface 105 also includes an inwardly directed annular shoulder 109 adjacent the frustoconical portion 108. When the retaining sleeve 104 is pushed over the end of the discharge tube 46 with the seal 92 fitted around the nipple 58 and the plug 72, the flange 106 will expand and snap into the annular groove 62 to thereby retain the retaining sleeve 104 to the end of the discharge tube 46. When the flange 106 locks into the groove 62, the shoulder 109 of the retaining sleeve 104 will abut against the annular shoulder 101 of the seal 92, thereby retaining the seal 92 against the nipple 58 and against the plug 72.

Figure 7:
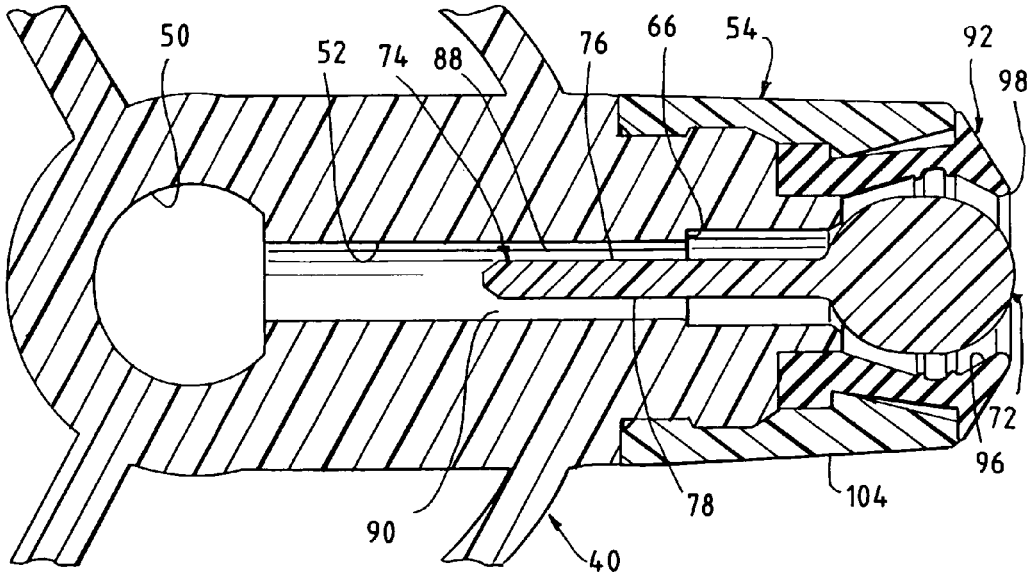
FIG. 7 is a cross-sectional view of the actuator and nozzle as shown in FIG. 2 with the seal deformed to allow liquid dispensed by the valve to escape.

Referring to FIGS. 2, 3, 6, and 7, when the valve 16 is not being actuated, the inner surface of the elastomeric seal 92 seals around a portion of the plug 72 thereby preventing contaminants from entering the passage 52. When the valve 16 is actuated and pressurized liquid is expelled through the passage 52, the liquid 13 will pass through the small passageways 88, 90 on opposite sides 76, 78 of the stem 74 and between the countersink 64 and a portion of the plug 72 until it encounters the seal 92. As more liquid 13 is expelled through the passage 52, the pressure of the liquid 13 will cause the frustoconical portion 96 of the seal 92 to become expanded. The expansion of the frustoconical portion 96 results in a corresponding expansion of the outer surface of the seal 92 into the flared portion 108 of the retaining sleeve 104 as shown in FIG. 7. With the seal 92 expanded, the liquid 13 can pass around the outer circumference of the plug 72 and out the small diameter opening 98 at the distal end of the seal 92 and into the ambient.

The diameters of the various passageways 52, 68, the configuration of the bulb 72 and of the elastomeric seal 92 are greatly determined by certain physical properties of the dispensing device 10. Specifically, the amount of pressure within the container 12 and the viscosity of the liquid, gas, or gel 13 therein influence the shapes of these parts. For example, if the fluid 13 has a viscosity that limits the flow of the fluid 13 through the passageways 88, 90 and around the stem 72, the pressure within the container 12 may be insufficient to force the fluid through the narrow passageways and around the bulb 72. Similarly, the seal 92 must have sufficient thickness and elasticity so as to open a passage sufficient to allow the fluid 13 to pass through. On the other hand, when fluid is not being released to the discharge tube 46, the elastomeric seal 92 must apply sufficient compressive forces to the outer surface of the bulb 72 to provide a good seal so as to prevent contaminants from entering the passages 52, 68. The structure of the various parts, including the bulb 72, stem 74, the seal 92 and of the retaining sleeve 104 that holds the parts together are largely determined by these properties.

Figure 8:
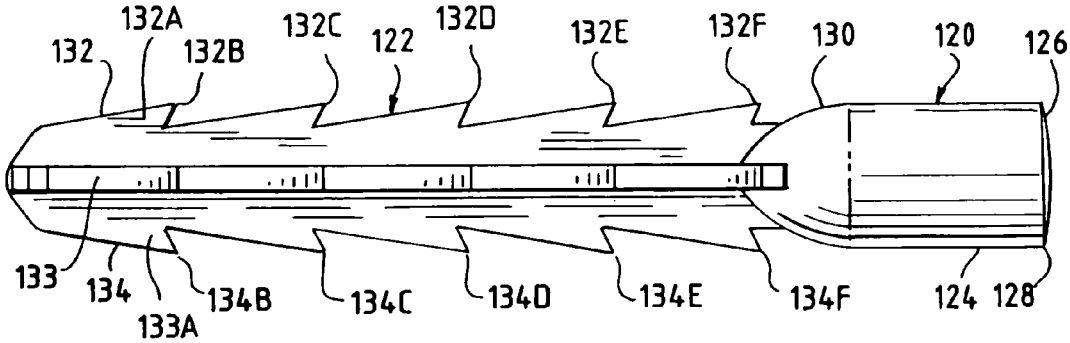
FIG. 8 is a side elevational view of a second embodiment of a plug and stem.
Figure 9:
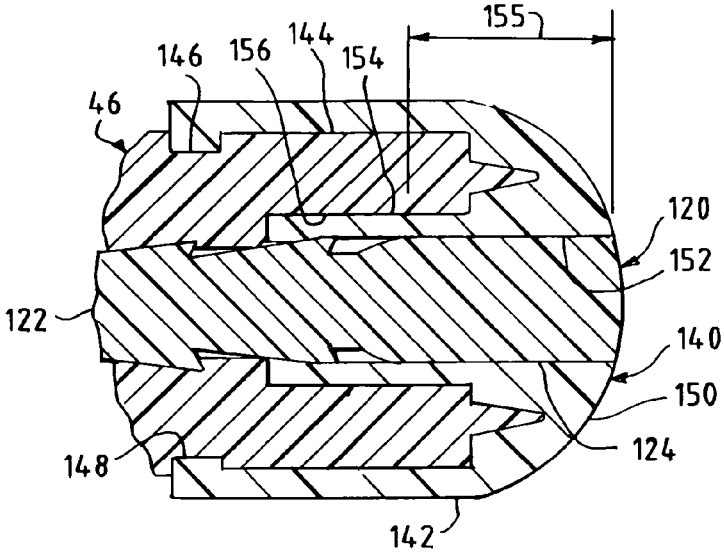
FIG. 9 is a cross-sectional view of a second embodiment of a seal for use with the plug shown in FIG. 8.
Figure 9A:
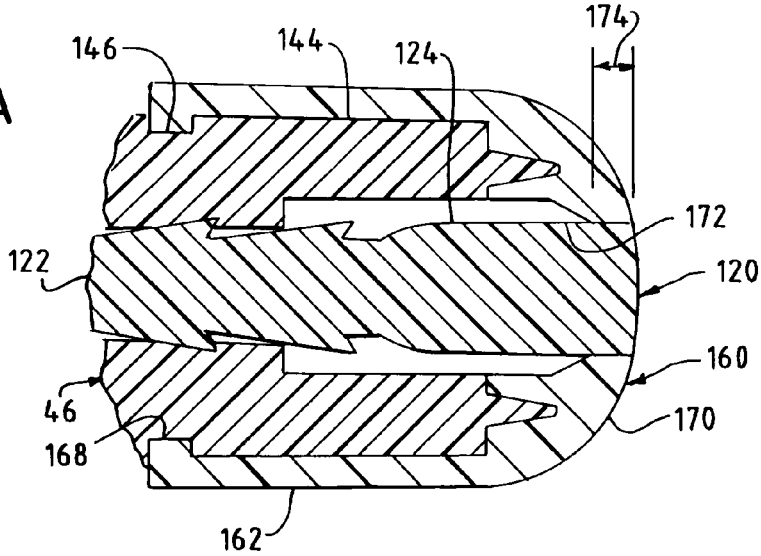
FIG. 9A is a cross-sectional view of a modification of the seal shown in FIG. 9.
Figure 10:
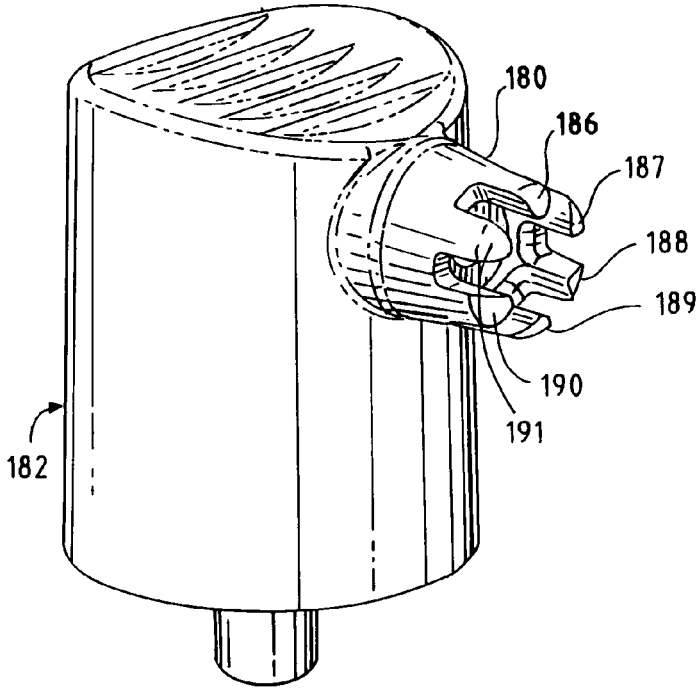
FIG. 10 is an isometric drawing of an actuator with a modified nozzle having a plurality of spaced fingers to provide support to the seal.
Figure 11:
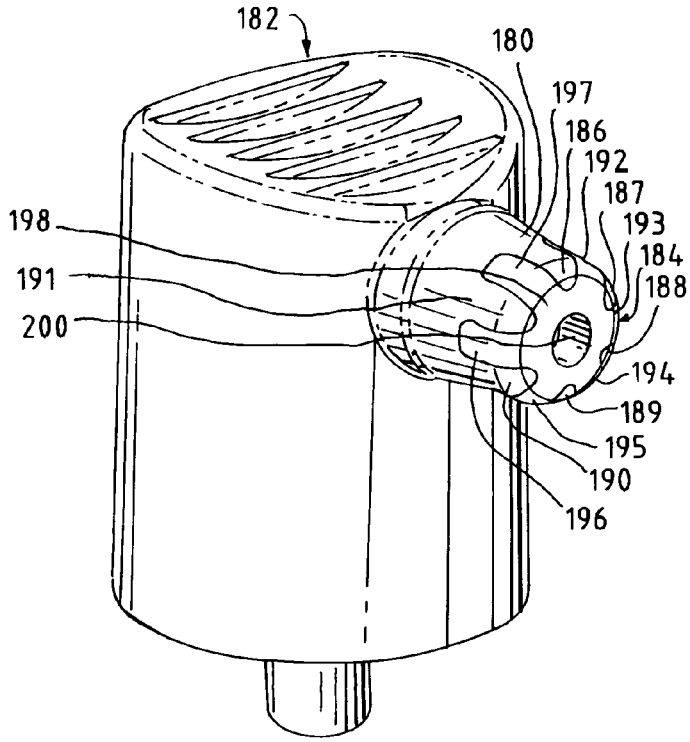
FIG. 11 is an isometric view of an actuator and nozzle as shown in FIG. 10 that has been over-molded to form a seal.
Figure 12:
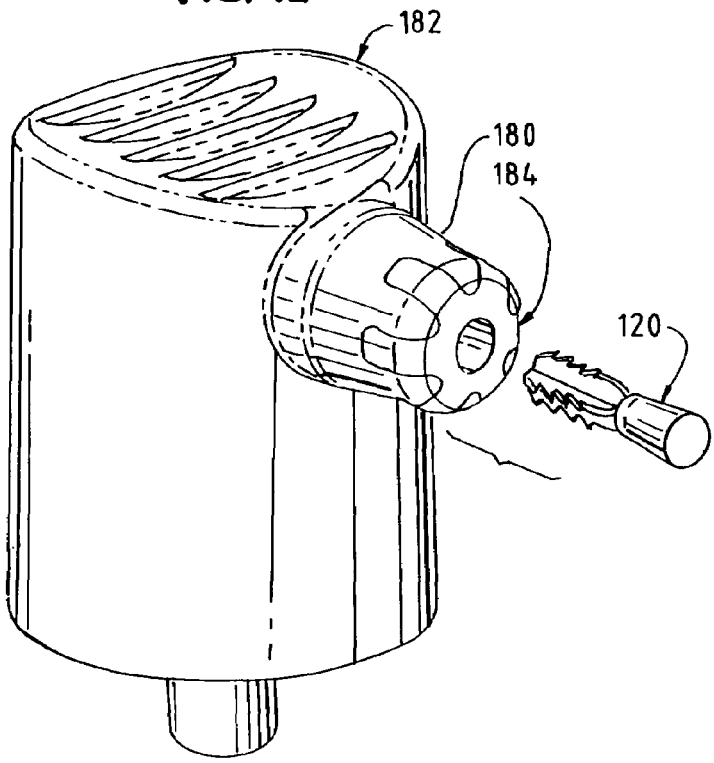
FIG. 12 is an exploded view of the nozzle shown in FIG. 11.
Figure 13:
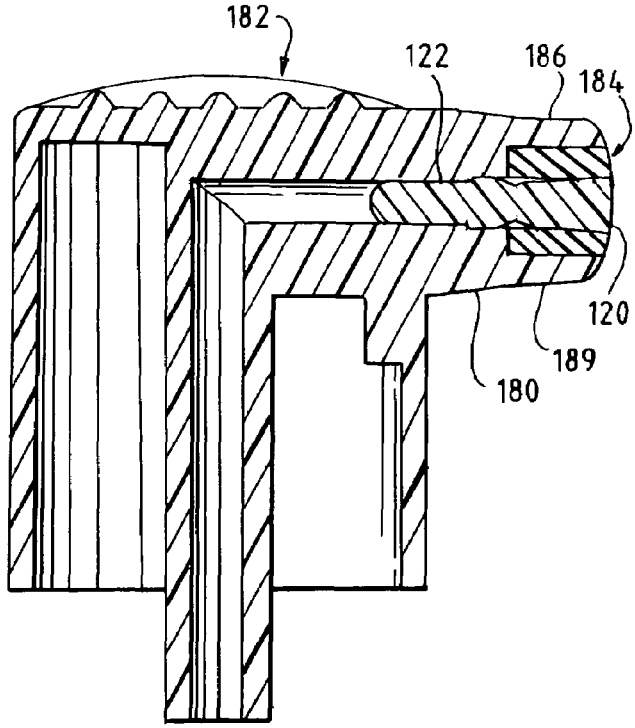
FIG. 13 is a cross-sectional view of the nozzle shown in FIG. 11.
Figure 14:
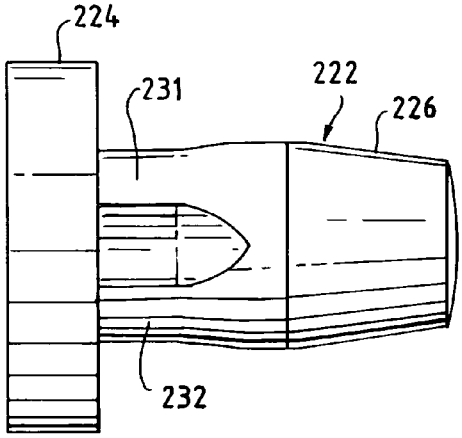
FIG. 14 is an enlarged side elevational view of another embodiment of a plug.
Figure 15:
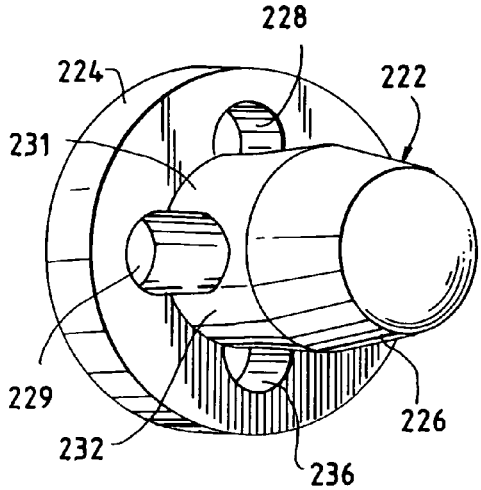
FIG. 15 is an isometric view of a plug shown in FIG. 14.
Figure 16:
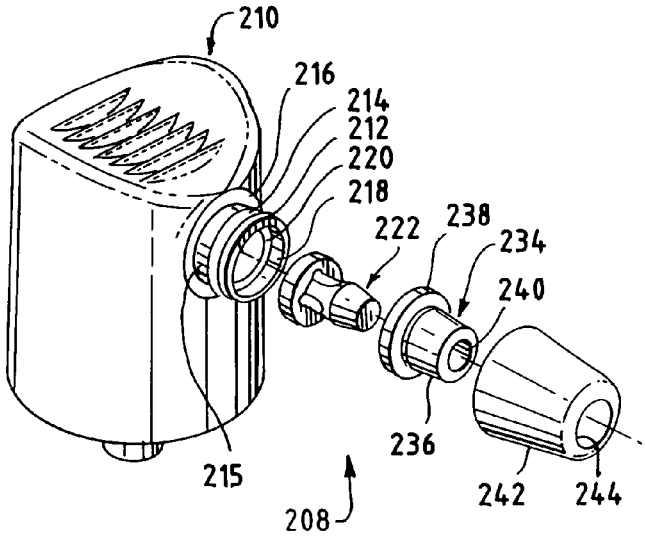
FIG. 16 is an exploded isometric view of a nozzle incorporating the plug shown in FIG. 14.
Figure 17:
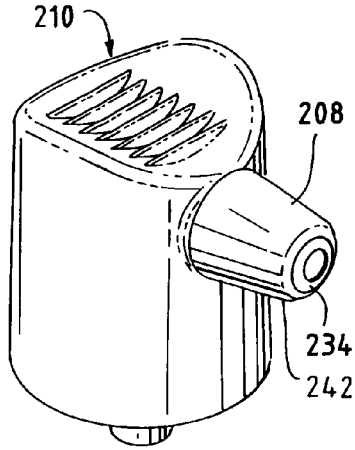
FIG. 17 is an isometric view of the nozzle shown in FIG. 16 assembled.
Figure 19:
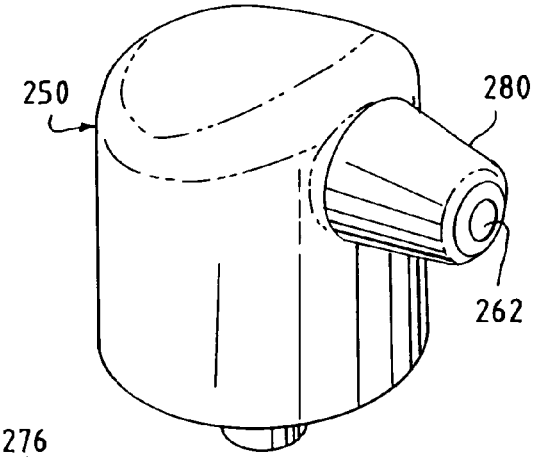
FIG. 19 is an isometric view of the assembled actuator shown in FIG. 19.
Figure 18:
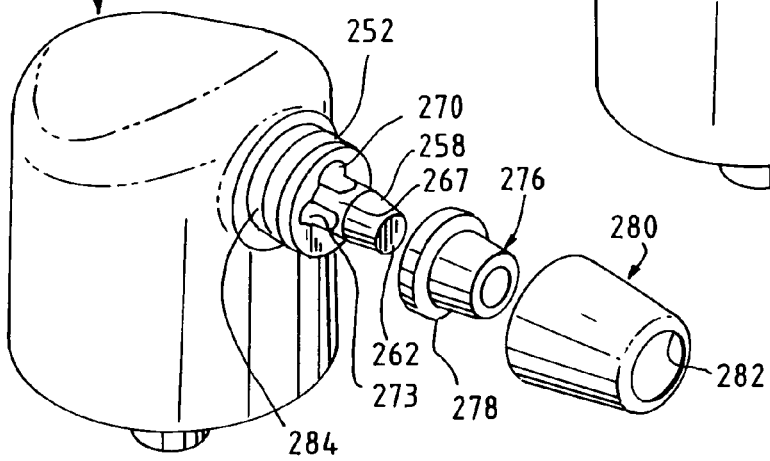
FIG. 18 is an exploded isometric view of an actuator where the plug is molded into the actuator.
Figure 20:
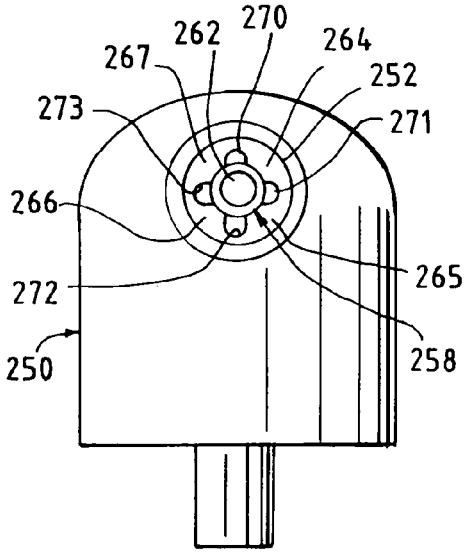
FIG. 20 is a front elevational view of the actuator shown in FIG. 18.
Figure 21:
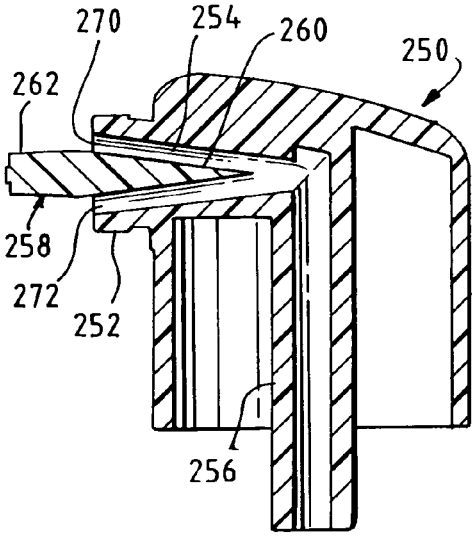
FIG. 21 is a cross-sectional view of the actuator shown in FIGS. 18.
Figure 22:
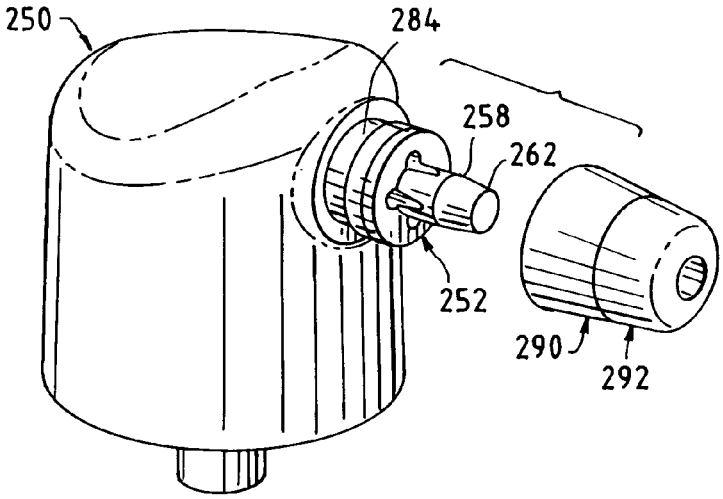
FIG. 22 is an exploded isometric view of the actuator depicted in FIG. 18 having a cap and seal assembled thereto where the seal is over molded to the cap.
Figure 23:
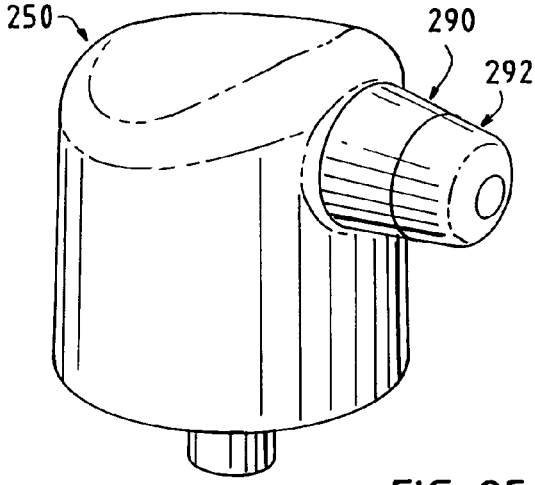
FIG. 23 is an assemble isometric view of the actuator, cap, and seal depicted in FIG. 22.
Figure 24:
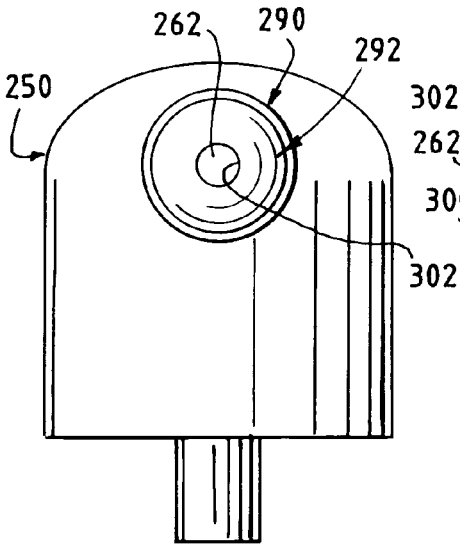
FIG. 24 is a front end view of the actuator, cap, and seal shown in FIG. 22.
Figure 25:
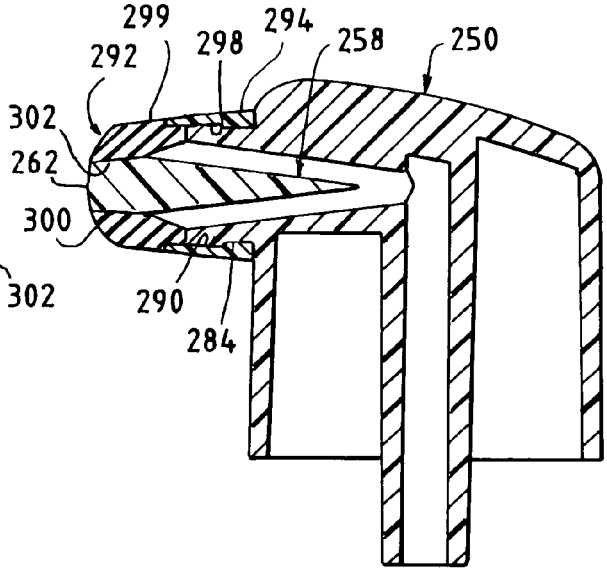
FIG. 25 is a cross-sectional view of the assembled actuator, cap, and seal shown in FIG. 22.
Figure 26:
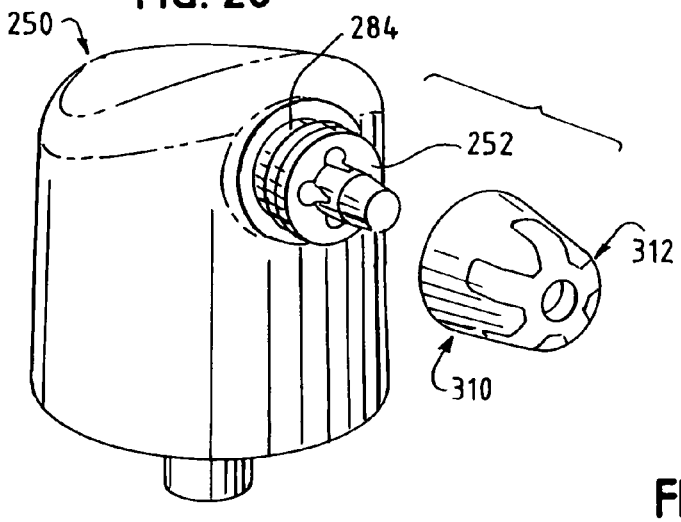
FIG. 26 is an exploded view of the actuator depicted in FIG. 18 having a cap and seal assembled thereto with the seal over molded onto the cap, but the parts having a configuration different from that depicted in FIG. 22.
Figure 27:
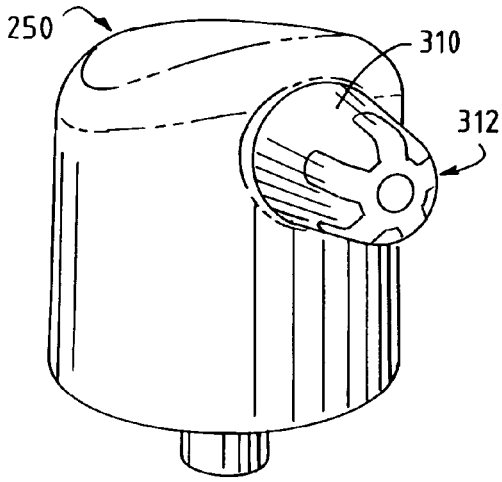
FIG. 27 is an isometric view of the actuator, cap, and seal shown in FIG. 26 assembled together.
Figure 28:
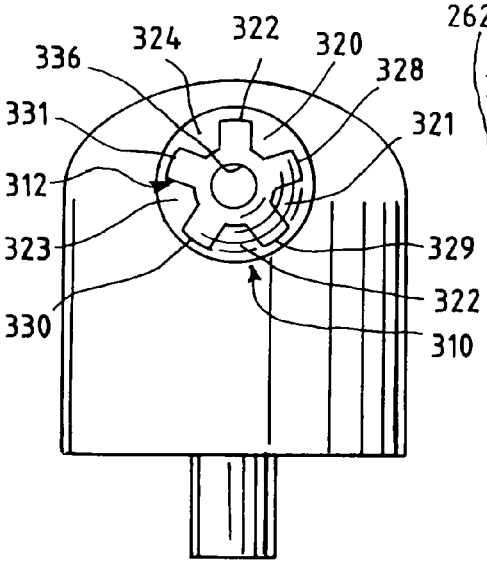
FIG. 28 is a front end view of the assembled actuator, cap, and seal as shown in FIG. 26.
Figure 29:
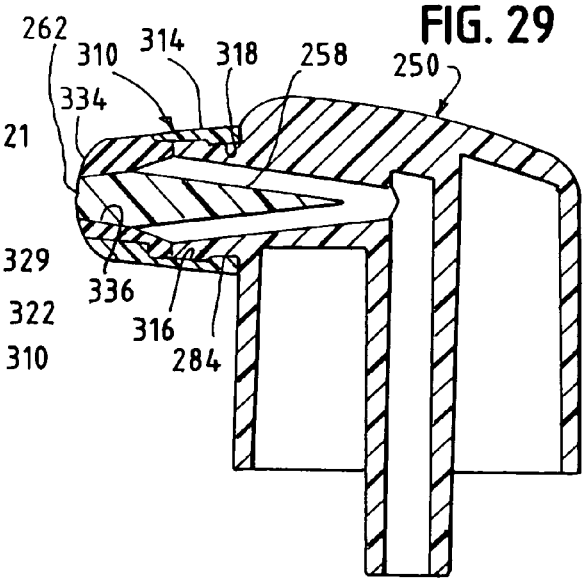
FIG. 29 is a cross-sectional view of the assembled actuator, cap, and seal as shown in FIG. 26.

Referring to FIGS. 8, 9, and 9A, in which an alternative configuration of a bulb 120 and associated stem 122 is depicted. In this embodiment, the bulb 120 has a generally cylindrical body 124 and a generally planar outer end 126. It may be preferably, depending on the physical qualities of the propellant and liquid 13 in the container 12, that the central body 124 be slightly frustoconical with the larger end thereof 128 at the intersection with the planar outer end 126. Inward of the central body 124 is a generally hemispherical portion 130 of the bulb 120 to which the outer end of the stem 122 attaches. The stem 122 has four radially extending flanges, three of which, 132, 133, 134 are visible in FIG. 8, with each of the flanges 132-134 having generally planar side surfaces of which surfaces 132A and 133A are visible. The outer surfaces of the flanges 132-134 have a plurality of outwardly directed barbs with the barbs 132B, 132C, 132D, 132E, 132F of flange 132 and barbs 134B, 134C, 134D, 134E, 134F of flange 134 shown in side view in FIG. 8.

The ends of the barbs 132B-132F of flange 132 and the barbs 134B-134F of flange 134 are radially spaced apart a distance from each other that is greater than the diameter of the passage 52 of the discharge tube 46 into which the stem 122 is inserted such that the barbs 132B-132F, 134B-134F will engage the inner wall of the passage 52 and thereby retain the stem 122 therein not withstanding the pressure applied by the propellant in the container 12 against the stem 122 and the bulb 120.

One advantage of a generally cylindrical bulb 122 is that it can be employed with a variety of configurations of elastomeric seals such that the properties of the seal can be matched to the physical properties of the fluid 13 and the propellant in the container 12. In FIG. 9, a seal 140 having a substantially large mass of elastomeric material is fitted around the bulb 120 so as to provide a relatively strong seal which can only be overcome in response to relatively high internal pressure applied by the propellant in the container 12.

The elastomeric seal 140 includes a generally tubular body 142 fitted around a tubular outer end 144 of a discharge tube 46. The tubular outer end 144 may include an annular groove 146 into which an inwardly directed annular flange 148 of the seal 140 extends to retain the seal 140 over the end of the discharge tube 46. Alternately, the tubular body 142 may be over molded onto the discharge tube 46. The seal 140 further has a generally hemispherical outer end 150 with a cylindrical axial opening 152 that is fitted around the cylindrical central body 124 of the bulb 120. The seal 140 further includes a second, inner tubular portion 154 that extends rearwardly into a enlarged diameter bore 156 in the tubular outer end 144 of the discharge tube 46. As a result of the inner tubular portion 154, the cylindrical axial opening 152 extends along the entire length 155 of the central body 124 of the bulb 120 such that the amount of elastomeric material surrounding the bulb 120 is maximized. Similarly, the surface area of the seal 140 that contacts the surface of the bulb 120 is likewise maximized, thereby providing a stronger seal between the inner surface of the central opening 152 of the seal 140 and the outer surface of the bulb 120.

On the other hand, FIG. 9A discloses another seal 160 fitted around the bulb 120 in which the volume of the elastomeric material is minimized, thereby applying a relatively weak force against the surface of the bulb 120 to permit the release fluid 13 from the container 12 under a lesser head of pressure from a propellant.

The seal 160 also has a tubular body 162 that fits around the tubular outer end 144 of the discharge tube 46. The parts may be retained together by flanges as shown or by over molding the seal to the end of the discharge tube. A hemispherical outer end 170 extends across the outer end 144 of the discharge tube 46. A cylindrical axial opening 172 in the seal 160 fits around the outer end portion of the generally cylindrical central body 124 of the bulb 120. In this embodiment, the cylindrical axial opening 172 has a length 174 that is much shorter than the length 155 of the cylindrical opening 152 of the seal 140 depicted in FIG. 9 and therefore the force applied against the surface of the bulb 120 by the seal 160 is far less than that applied by the seal 140. Accordingly, the seal 160 depicted in FIG. 9A can be more easily deformed, and when deformed allow a larger passageway around the surface of the bulb 120 once the fluid 13 is released by the valve 16.

Referring to FIGS. 10 through 13, where the properties of the propellant and fluid 13 within the container 12 require that the seal apply an even stronger force against the outer surface of the bulb 120, a discharge tube 180 of an actuator 182 can be configured to provide additional support to an elastomeric seal 184. In this embodiment, the discharge tube 180 is configured into a plurality of space apart fingers 186, 187, 188, 189, 190, 191. The elastomeric seal 184 has a plurality of fingers 192, 193, 194, 195, 196, 197, the outer surfaces of which define a cylinder equal in diameter the end of the discharge tube 180. Each of the fingers 192-197 is also complementary in shape to the space remaining between the fingers 186-191 at the forward end of the discharge tube 180. Extending across the open end of the discharge tube 180 is a generally hemispherical forward end 198, and extending axially through the forward end 198 is a cylindrical opening 200 into which the tubular body 124 of the bulb 120 is fitted. In this embodiment, the sides of the fingers 192-197 of the seal 184 and are over molded onto the sides of the fingers 186-191 of the discharge tube 180 to thereby retain the seal 184 to the discharge tube 180 as a single part. The fingers 186-191 of the discharge tube provide structural support that surrounds the cylindrical body 124 of the bulb 120 to retain the rigidity of seal 184 where the fluid 13 in the container 12 is under a very strong pressure and a strong seal is needed between the inner surface of the seal 184 and the outer surface of the bulb 120.

Referring to FIGS. 14 through 17, a self-sealing nozzle 208 in accordance with the present invention can be made without requiring the provision of a stem that extends into an opening 52 of a discharge tube such as stem 74 or stem 122 described with respect to the two previous embodiments. In this embodiment, an actuator 210 has a tubular discharge tube 212 having a radial flange 214 at the outer end thereof such that an inwardly directed annular groove 215 is formed behind the radial flange 214 and an annular surface 216 around the discharge tube 212. The discharge tube 212 also has a central inner opening 218 that communicates with the stem 28 of the valve 16 and through which fluid from within the container 12 is released. The inner opening 218 has an inner shoulder 220 against which is fitted a plug 222. The plug 222 has a cylindrical base 224, the outer diameter of which is sized to snuggly fit within the enlarged part of the inner opening 218 and against the shoulder 220 of the discharge tube 212. Forward of the base 224 is a generally cylindrical outwardly extending projection 226. Spaced around the projection 226 and extending through the base 224 is a plurality of cylindrical ports, three of which 228, 229, 230, are visible. The body of the plug 222 is therefore retained to the base 224 by a plurality of ribs 231, 232 remaining between the ports 228, 229, 230. When the plug 222 is fitted into the inner opening 218 of the discharge tube 212, fluid passing through the central opening 218 from the valve 16 and container 12 can pass through the ports 228-231 and around the projection 226.

Extending around the projection 226 of the plug 222 is an elastomeric seal 234. The seal 234 has a generally tubular central body 236 at the rearward end of which is a radially flange 238. The central opening 240 of the seal 234 fits around the cylindrical projection 226 of the plug 222 and is retained in place by a cap 242. The inner surface of the cap 242 includes a shoulder, not shown, that engages the radial flange 238 of the seal 234 and retain it against the outer surface of the base 224 of the plug 222. An inwardly directly radial flange, also not shown, on the inner surface of the cap 242 engages the annular groove 215 behind the radial flange 214 on the discharge port 212 to retain the cap 242 and thereby retain the various parts of the nozzle 208 to the discharge tube 212 of the actuator 210. In another variation, the elastomeric seal 234 is over molded into the cap 242 to retain these parts together.

In this embodiment, pressurized liquid will flow through the ports 228-230, around the cylindrical projection 226 of the plug 222 and cause the elastomeric material of the seal 234 to expand. With the seal 234 expanded, liquid from within the container 12 can flow around the cylindrical projection 226 of the plug 222 and through a central opening 244 at the outer end of the cap 242.

Although the nozzle 208, as described and depicted, has a plug 222 that is manufactured separately from the actuator 210, the actuator and plug can be manufactured as a single member. Referring to FIGS. 18 to 21, in this embodiment an actuator 250 is made of a suitable molded plastic and has a discharge tube 252. The discharge tube 252 has a central opening 254 that forms a passage that communicates with the central opening of a vertically oriented central tubular portion 256 that receives the stem of the valve 16 and through which the fluid 13 is expelled. Molded as part of the actuator 250 is a plug 258 having a tapered inner end 260 and a generally bulbous outer end 262. The plug 258 is formed within the central 254 of discharge tube 252 and is retained therein by a plurality of ribs 264, 265, 266, 267, best seen in FIG. 20, that extend across portions of the central opening 254 and leave ports 270, 271, 272, 273 between the ribs 264-267. A tubular elastomeric seal 276 having outwardly directed radial flange 278 is fitted over the bulbous outer end 262 of the discharge port 252. Finally, a tubular retaining cap 280 having a generally cylindrical shaped inner opening with a constricted outer end 282 is fitted around the seal 276. An inwardly directed radial flange, not visible, at the rearward end of the cap 280 fits around the circumference of the discharge tube 252 and engages an annular groove 284 to retain the cap 280 and the seal 276 to the end of the discharge tube 252. With the parts assembled together, fluid 13 released by the valve 16 from the container 12 and expelled down the central opening 254 of the discharge tube 252 will pass through the ports 270-273. The fluid 13 will then flow around the bulbous outer end 262 of the plug 258 causing the seal 276 to expand within the cylindrical interior of the cap 280.

Referring to FIGS. 22 through 25, the elastomeric seal may also be over molded directly into the tubular retaining cap. In this embodiment, the retaining cap 290 is provided with a seal 292 that is over molded to a surface thereof such that the cap 290 and seal 292 form a single unit. The cap 290 and seal 292 are then attachable to the actuator 250 described and depicted in FIGS. 18 through 21. The cap 290 is tubular in shape with a gently tapered outer surface 294 that provides an attractive exterior to the discharge end of the actuator 250. The inner surface 296 of the cap 290 has a inwardly directed annular flange 298 at the inner end thereof for engaging the annular groove 284 of the actuator 250 and retaining the cap 290 to the actuator 250. Over molded around the open outer end of the cap 290 is the seal 292, which is also generally tubular in shape having an outer surface 299 that blends into the tapered outer surface 294 of the cap, a hemispherical outer end 300 and a central opening 302 that seals against the bulbous outer end 262 of the plug 258 in the actuator. As discussed with respect to other embodiments of the seal, the contact area between the central opening 302 of the seal 290 and the bulbous outer surface 262 of the plug must be engineered to be suitable for the viscosity of the fluid 13 and the pressure in the container 12 provided by the propellant.

Referring to FIGS. 26 through 29 in which an embodiment is depicted that is useful where the various physical properties of the fluid 13 and the propellant require that the seal be capable of applying a relatively strong pressure to the bulbous outer end 262 of the plug. In this embodiment, the cap 310 provides additional support to the seal 312. As was discussed regarding the cap 290 and seal 292, the seal 312 is over molded to the outer end of the cap 310 and the cap 310 is assembled to the actuator 250 first described with respect to FIG. 18. The cap 310 is again generally tubular in shape with an attractively configured outer surface 314 and an inner surface 316 that includes an inwardly directed annular flange 318 for engaging the annular groove 284 around the discharge port 252 to thereby retain the cap to the discharge port 252. The outer end of the cap 290 includes a plurality of longitudinal axially extending fingers 320, 321, 322, 323, 324. Over molded to the open outer end of the cap 310, and between the various fingers 320-324 is the seal 312 such that portions of the seal 312 extend between the various fingers 320-324 creating complementary fingers 328, 329, 330, 331, 332, on the seal 312. The seal 312 further has a somewhat hemispherical outer end 334 and a cylindrical central opening 336 for surrounding the bulbous outer end 262 of the plug 258 in the actuator 250.

With the cap 310 and seal 312 assembled to the discharge port 252 of the actuator 250, the cylindrical central opening 336 of the seal 312 the fingers 320-324 of cap 310 will lend structural support to the seal 312 and the seal 312 will fit tightly around the bulbous outer end 262.

While the present invention has been described with respect to a number of embodiments, it will be appreciated that many modifications and variations may be made without departing from the true spirit of the invention. It is therefore the intent of the appended claims to cover all such modifications and variations which fall within the true spirit and scope of the invention.

What is claimed:

1. A fluid dispensing device comprising a container for containing a fluid, a valve controlling the release of fluid from said container, a discharge tube having an inner opening communicating with a passage extending from said valve to the ambient, an actuator for opening said valve for initiating a discharge from said dispenser, a self-sealing nozzle at an end of said discharge tube, said self-sealing nozzle permitting the release of fluid while said valve is releasing fluid and sealing said inner opening from the ambient when said valve is not releasing fluid wherein said nozzle includes a plug, a retaining member for said plug at said end of said discharge tube, and an elastomeric seal around said plug, said seal having a contracted condition wherein an inner surface of said seal is sealed against said plug when fluid is not being expelled through said valve and having an expanded condition wherein said inner surface is spaced form said plug thereby allowing fluid to flow from said passage and around said plug when fluid is being expelled from said valve.

2. The fluid dispensing device of claim 1 wherein said self-sealing nozzle permits the release of fluid when the valve is releasing fluid and seals said inner opening when said valve is not releasing fluid independent of the operation of said actuator.

3. The fluid dispensing device of claim 1 wherein said retaining member defining an opening through which fluid from said passage can flow around said plug.

4. The fluid dispensing device of claim 3 wherein said retaining member comprises an elongate stem one end of which is joined to said plug and another end of which extends into said inner opening and said opening of said retaining member is formed between a wall of said passage and a surface of said stem.

5. The fluid dispensing device of claim 4 wherein said plug is generally cylindrical.

6. A dispensing device having a valve and a discharge port, said discharge port having a distal end and an opening in said distal end, said dispensing device further having a passage extending from said valve to said opening in said discharge port and having a self-sealing nozzle at said discharge port, said self-sealing nozzle comprising, a plug, a retaining member for retaining said plug at said end of said discharge tube, said retaining member defining an opening through which fluid from said passage can flow around said plug, and an elastomeric seal around said plug, said seal having a contracted condition wherein an inner surface of said seal is sealed against said plug when fluid is not being expelled through said valve and having an expanded condition wherein said inner surface is spaced from said plug thereby allowing fluid to flow from said passage and around said plug when fluid is being expelled from said valve.

7. The fluid dispensing device of claim 6 and further comprising an actuator for controlling said valve and wherein said self-sealing nozzle permits the release of fluid when the valve is releasing fluid and seals said inner opening when said valve is not releasing fluid independent of the operation of said actuator.

8. In a dispensing device comprising a container for containing a fluid to be dispensed, a valve for dispensing fluid from said container, a moveable actuator for controlling said valve, a discharge tube having an opening communicating with a passage leading to said valve through which said fluid will flow, the improvement comprising a self-sealing nozzle in said discharge tube for sealing said passage from the ambient when said valve is not releasing fluid from said container and for opening said passage to the ambient when said valve is releasing fluid from said dispensing container, said self-sealing nozzle including a plug, a retaining member for retaining said plug at said end of said discharge tube, and an elastomeric seal around said plug, said seal having a contracted condition wherein an inner surface os said seal is sealed against said plug when fluid is not being expelled through said valve and having an expanded condition wherein said inner surface is spaced form said plug thereby allowing fluid to flow from said passage and around said plug when fluid is being expelled from said valve.

9. The dispensing device of claim 8 wherein said retaining member further comprises an opening through which fluid from said passage can flow around said plug.

* * * * *